US009299510B2

(12) United States Patent
Cheong

(10) Patent No.: US 9,299,510 B2
(45) Date of Patent: Mar. 29, 2016

(54) KEY BUTTON APPARATUS

(71) Applicant: Samsung Electronics Co., Ltd., Suwon-si, Gyeonggi-do (KR)

(72) Inventor: Hyun-Mi Cheong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 40 days.

(21) Appl. No.: 14/067,031

(22) Filed: Oct. 30, 2013

(65) Prior Publication Data

US 2014/0144762 A1 May 29, 2014

(30) Foreign Application Priority Data

Nov. 28, 2012 (KR) ..... 10-2012-0135797

(51) Int. Cl.
*H01H 13/06* (2006.01)
*H01H 13/86* (2006.01)

(52) U.S. Cl.
CPC ..... *H01H 13/06* (2013.01); *H01H 13/86* (2013.01); *H01H 2221/05* (2013.01); *H01H 2221/082* (2013.01); *H01H 2223/002* (2013.01); *H01H 2229/047* (2013.01)

(58) Field of Classification Search
CPC . H01H 13/06; H01H 13/86; H01H 2229/047; H01H 2221/082; H05K 5/0026
USPC ..... 200/302.2; 341/22; 345/168, 169
See application file for complete search history.

(56) References Cited

U.S. PATENT DOCUMENTS 4,814,566 A * 3/1989 Sigl ..... H01H 13/7006 200/305
6,621,446 B1 * 9/2003 Chaillie ..... E05B 19/04 200/302.1
7,626,133 B2 * 12/2009 Wu ..... H01H 13/704 200/341
7,705,255 B2 * 4/2010 Yokote ..... H01H 13/06 200/302.2
8,106,320 B2 * 1/2012 Kunthady ..... B32B 3/02 200/302.1
8,693,201 B2 * 4/2014 Yamazaki ..... H01H 13/705 200/341
2006/0038706 A1 * 2/2006 Berthou ..... H01H 13/702 341/22
2007/0034493 A1 * 2/2007 Kawasaki ..... H01H 13/86 200/302.2
2011/0284352 A1 * 11/2011 Kitahara ..... H01H 13/06 200/341
2013/0048482 A1 * 2/2013 Saitou ..... H01H 13/06 200/341
2013/0050919 A1 * 2/2013 Matsui ..... H04M 1/18 361/679.01

FOREIGN PATENT DOCUMENTS

| | | | |
|---|---|---|---|
| CN | 1881498 | A | 12/2006 |
| CN | 101420643 | A | 4/2009 |
| DE | 103 08 204 | B3 | 2/2004 |
| JP | 2007-273304 | A | 10/2007 |
| KR | 10-0182042 | B1 | 12/1998 |
| KR | 10-2004-0056773 | A | 7/2004 |

OTHER PUBLICATIONS

Australian Office Action dated Sep. 25, 2015.
Chinese Office Action dated Feb. 1, 2016.

* cited by examiner

*Primary Examiner* — Kyung Lee
(74) *Attorney, Agent, or Firm* — Jefferson IP Law, LLP

(57) ABSTRACT

A key button apparatus is provided. The key button apparatus includes a housing having an opening, a moveable key button, a sealing member configured to seal the opening of the housing, deformed by movement of the key button, and molded of a plurality of elastic bodies made of different materials, and a switch disposed inside of the housing and pressed by deformation of the sealing member.

20 Claims, 7 Drawing Sheets

KEY BUTTON APPARATUS

CROSS-REFERENCE TO RELATED APPLICATION(S)

This application claims the benefit under 35 U.S.C. §119 (a) of a Korean patent application filed on Nov. 28, 2012 in the Korean Intellectual Property Office and assigned Serial No. 10-2012-0135797, the entire disclosure of which is hereby incorporated by reference.

TECHNICAL FIELD

The present disclosure relates to a key button apparatus. More particularly, the present disclosure relates to a key button apparatus and an electronic device thereof.

BACKGROUND

Currently, with the development of the electronic communication industry, electronic devices including portable terminals, such as mobile communication terminals (cellular phones), electronic tablets, and personal digital assistants, have become necessary articles of modern life and, therefore, important instruments for transmitting information which changes rapidly.

Generally, such an electronic device includes key buttons and processes signals generated when the key buttons are pressed.

FIG. 1 is a diagram illustrating a configuration of a key button apparatus according to the related art.

Referring to FIG. 1, the key button apparatus 10 includes an opening 121 that is formed in a housing 12 which forms the external appearance of an electronic device, a sealing rubber 13, that has a container shape, is inserted into the opening 121, and seals the opening 121, a key button 11 that is fitted into an accommodating portion 132 of the sealing rubber 13, a shaft portion 111, and a dome switch 14 disposed under the sealing rubber 13. When the key button 11 is pressed downward, the key button 11 through the shaft portion 111 presses a bottom 133 of the sealing rubber 13 and the bottom 133 of the sealing rubber 13 is stretched to press the dome switch 14. When the dome switch 14 is pressed, the connection state thereof is changed and the electronic device recognizes a signal associated with change in the connection state of the dome switch 14.

Since the sealing rubber 13 seals the opening 121 of the housing 12, water is not introduced to the inside of the electronic device. However, in order to prevent the introduction of water using the sealing rubber 13, it is necessary to eliminate gaps between the opening 121 of the housing 12 and the sealing rubber 13. For this purpose, the sealing rubber 13 is formed to be tightly fitted into the opening 121 of the housing 12. In addition, it is necessary to prevent the sealing rubber 13 from being damaged by fatigue caused when the key button 11 is frequently pressed. For this purpose, the sealing rubber 13 is required to have a relatively large thickness. The relatively large thickness of the sealing rubber 13 makes assembling easier to couple the sealing rubber 13 to the opening 121 of the housing 12. However, since the bottom 133 of the sealing rubber 13 that is pressed by the key button 11 is required to have a relatively large thickness operability of the key button 11 is degraded because the bottom 133 is thick.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a key button apparatus for preventing foreign matters, such as water or dust, from being introduced to the inside of an electronic device through any gap formed between the opening of a housing and a key button which is disposed in the opening of the housing to press the internal switch of the electronic device.

Another aspect of the present disclosure is to provide a key button apparatus for reducing the thickness of a sealing member which seals the opening of an electronic device and is stretched due to its elastic property when a key button is pressed, thereby improving operability.

Another aspect of the present disclosure is to provide a key button apparatus having a sealing member which seals the opening of an electronic device and is hardly damaged even by frequent pressing of a key button Another aspect of the present disclosure is to provide a key button apparatus having a sealing member which is stretched due to its elastic property when a key button is pressed and is formed by attaching a polyurethane film to a silicon rubber using in-mold injection molding.

In accordance with an aspect of the present disclosure, a portable terminal apparatus is included. The portable terminal apparatus includes a housing having an opening, a moveable key button, a sealing member configured to seal the opening of the housing, deformed by movement of the key button, and molded of a plurality of elastic bodies made of different materials, and a switch disposed inside of the housing and pressed by deformation of the sealing member.

In accordance with another aspect of the present disclosure, an electronic device is provided. The electronic device includes a housing having an opening and configured to form an external appearance of the electronic device, a sealing member fitted into the opening of the housing to seal the opening of the housing and having a shape of an upwardly open container and a protrusion which is formed in at a bottom of the sealing member and moves downwards by movement of the key button, the key button exposed through the opening of the housing, disposed not to be detached from the housing, movable downward, and configured to press the bottom of the sealing member by a downward movement, a switch disposed inside the housing and under the bottom of the sealing member, and configured to be pressed by the protrusion of the sealing member that is move downwards and a main board electrically connected to the switch and configured to process a signal generated when the switch is pressed, wherein the sealing member is molded by in-mold injection molding and has a silicon rubber to which a polyurethane film is attached.

Other aspects and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

The same reference numerals are used to represent the same elements throughout the drawings.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions or constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
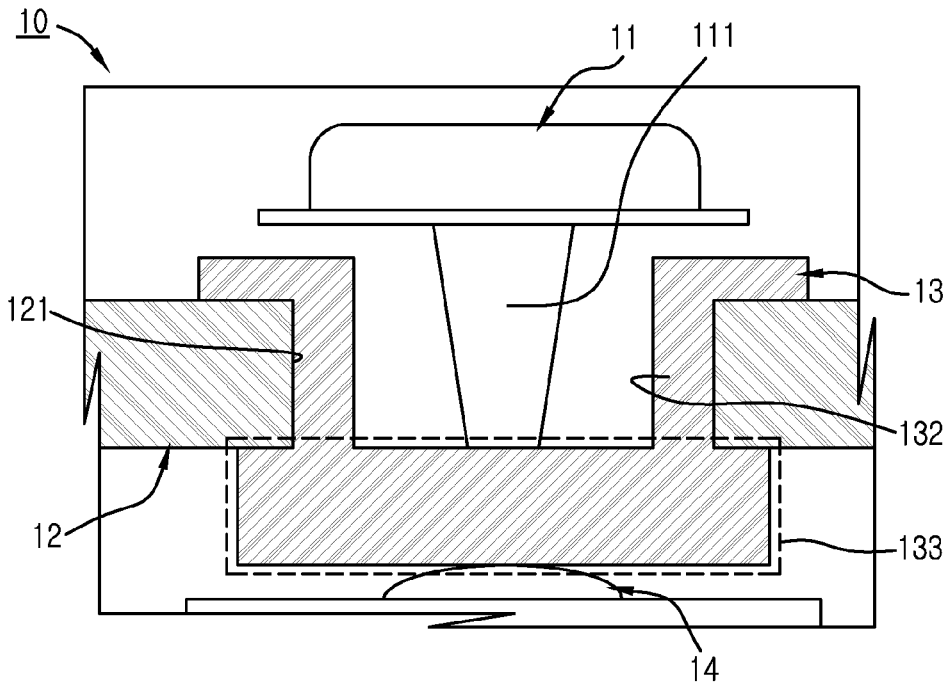
FIG.1 (RELATED ART)
FIG. 1 is a diagram illustrating a configuration of a key button apparatus according to the related art.
Figure 2:
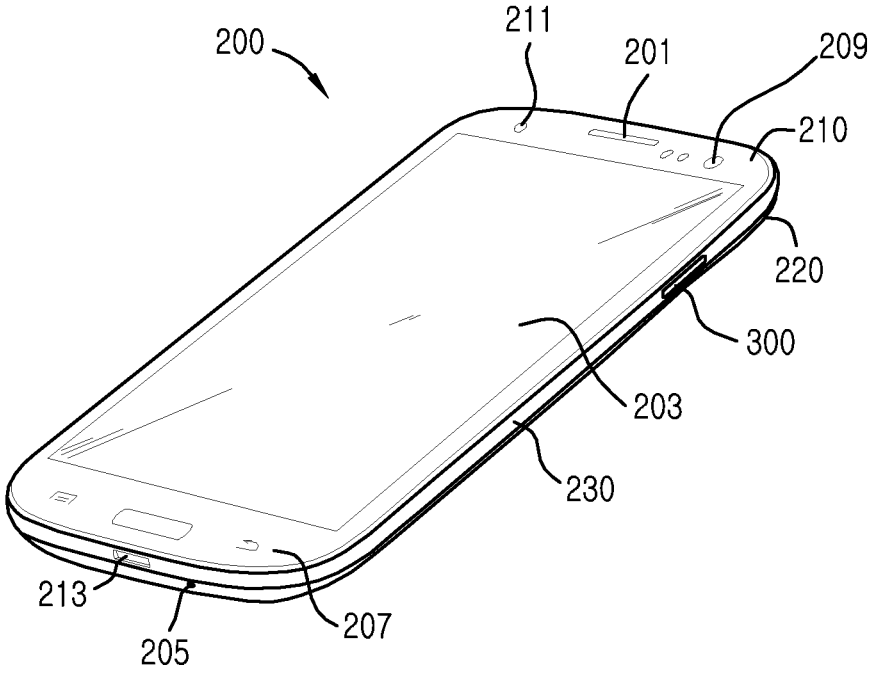
FIG. 2 is a perspective view illustrating an electronic device according to an embodiment of the present disclosure.

FIG. 2 is a perspective view illustrating an electronic device according to an embodiment of the present disclosure.

Referring to FIG. 2, the electronic device 200 includes a speaker device 201 for outputting sound, a touchscreen device 203 disposed in a lower portion of the speaker device 201 and configured to display images and receive a touch input, a microphone device 205 disposed in a lower portion of the touchscreen device 203 and configured to receive sound, a keypad device 207 having touch key buttons arranged therein, a key button apparatus 300 including a key button, and a camera device 209. The electronic device further includes a power connector 213 for charging the electronic device 200 and a sensor 211 for sensing various external conditions. For example, the sensor 211 may sense external light and thus appropriately control the brightness of the screen or the sensor 211 may sense eye movement of the user of the electronic device 200 and thus control movement of the contents of the screen.

The key button of the key button apparatus 300 is disposed in the opening of a housing that forms the external appearance of the electronic device 200. When a user presses the key button, the key button moves into the inside of the housing and presses an internal switch.

The electronic device 200 includes the housing that forms the external appearance thereof, and the above-described elements are accommodated in the accommodating space of the housing. The housing includes a front housing 210 and a rear housing 220 which are coupled to each other, and a metal rim 230. The front housing 210 is disposed in a front side of the electronic device 200, and the rear housing 220 is disposed in a rear side of the electronic device 200. The metal rim 230 is disposed in the rim of the electronic device 200. The metal rim 230 may be coupled to the front housing 210 or the rear housing 220. Alternatively, the metal rim 230 may be coupled to a groove formed by the coupling between the front housing 210 and the rear housing 220. The front housing 210 has an opening opened frontward, and the touchscreen device 203 is exposed through the opening. The rear housing 220 includes a detachable battery cover. The user may take off the battery cover and then exchange a battery.

Figure 3:
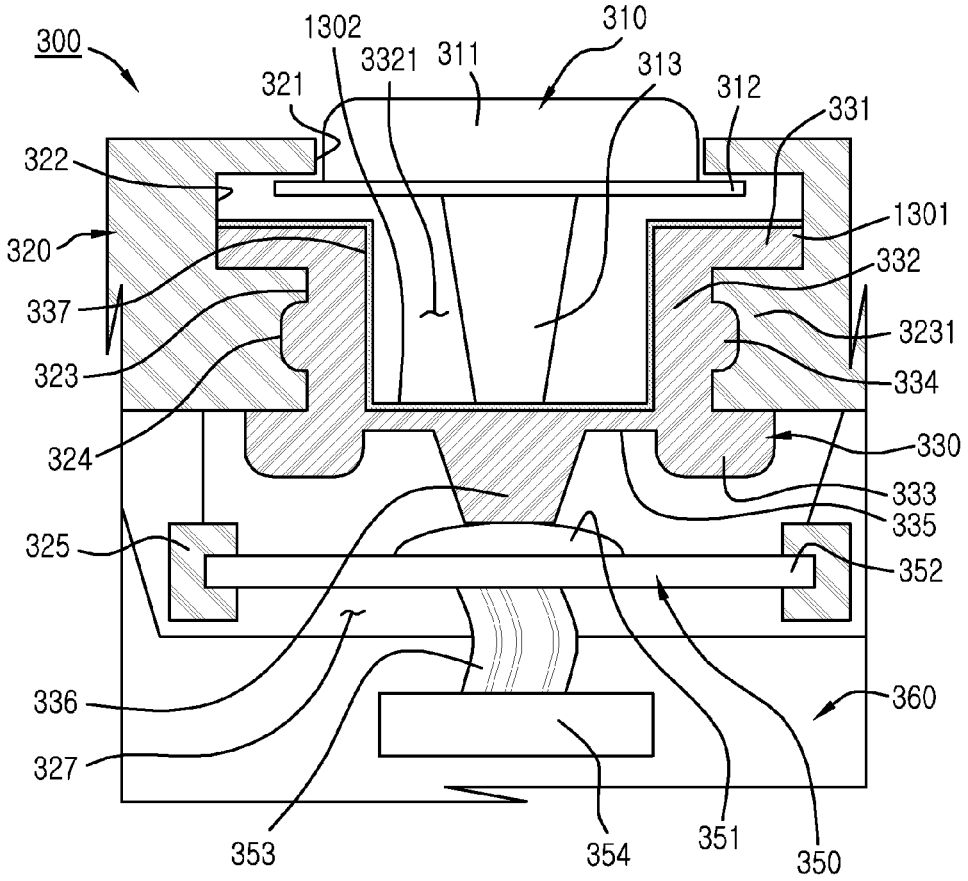
FIG. 3 is a diagram illustrating a configuration of a key button apparatus according to an embodiment of the present disclosure.

FIG. 3 is a diagram illustrating a configuration of a key button apparatus according to an embodiment of the present disclosure.

Referring to FIG. 3, the key button apparatus 300 includes a key button 310, a housing 320, a sealing member 330, a switch device 350, and a main board 360.

The key button 310 includes a head portion 311, a flange portion 312 coupled to the bottom of the head portion 311, and a shaft portion 313 coupled to the bottom of the flange portion 312. The flange portion 312 has a larger width than the head portion 311 to prevent the key button 310 from being detached from the housing 320. The shaft portion 313 has a rod shape and, when the key button 310 is pressed, transfers relevant pressure downward. The head portion 311, the flange portion 312, and the shaft portion 313 may be molded integrally by injection molding, and be formed of metal or non-metal material. In addition, the key button 310 may be inserted into the opening of the housing 320 and be moved downward. However, the key button 310 is hardly detached from the housing 320.

The housing 320 forms the external appearance of the electronic device 200. The housing 320 may be the front housing 210 and the rear housing 220 as described with reference to FIG. 2. The opening of the housing 320 has an upper hollow 321, a central hollow 322 that communicates with the upper hollow 321 and is disposed under the upper hollow 321, and a lower hollow 323 that communicates with the central hollow 322 and is disposed under the central hollow 322. The central hollow 322 of the housing 320 has a larger width than the upper hollow 321 and the lower hollow 323. Since the flange portion 312 of the key button 310 is disposed in the central hollow 322 of the housing 320 and has a larger width than the upper hollow 321 of the housing 320, the key button 310 is hardly detached from housing 320. Before the key button 310 is pressed, the upper portion of the head portion 311 in the key button 310 is maintained in a protruding state from the housing 320. In addition, a groove 324, into which the fitting protrusion 334 of the sealing member 330 is fitted, is provided inside the central hollow 322 of the housing 320.

The sealing member 330 is fitted into the opening of the housing 320 to block communication between the outside and the inside of the electronic device through the opening of the housing 320. The sealing member 330 has the shape of a container having a space 3321 capable of accommodating the shaft portion 313 extending downward from the flange portion 312 of the key button 310. Since the sealing member 330 comes into contact with the housing 320 closely, there is hardly any gap between the sealing member 330 and the housing 320. Therefore, foreign objects, such as water or dust, are prevented from being introduced to the housing 320, that is, the inside of the electronic device through the opening of the housing 320. The sealing member 330 includes a silicon rubber 1301 and a polyurethane film 1302 attached to the top surface 337 of the silicon rubber 1301. The sealing member 330 may be molded by in-mold injection molding.

The sealing member 330 is shaped to surround a jaw 3231 that forms the lower hollow 323 of the opening of the housing 320. In addition, since the sealing member 330 is elastic, the sealing member 330 may be deformed. Therefore, there is no problem in the process of fitting the sealing member 330 into the jaw 3231 of the opening of the housing 320. The jaw 3231 of the opening of the housing 320 has three surfaces connected perpendicular to one another. The sealing member 330 has an upper wall 331, a side wall 332, and a bottom 333 which come into contact with the three surfaces of the jaw 3231 respectively. The jaw 3231 of the opening of the housing 320 may be molded in a rounded shape in addition to the shape as illustrated in FIG. 3. The sealing member 330 is molded in a shape corresponding to the shape of the jaw 3231. In addition, a fitting protrusion 334 is provided in the side wall 332 of the sealing member 330, and the fitting protrusion 334 is fitted into a groove 324 formed inside the lower hollow 323 of the opening, contributing to firm fixing of the sealing member 330 to the opening.

The shaft portion 313 of the key button 310 passes through the space 3321 of the sealing member 330 from top to bottom and comes into contact with the bottom 333 of the sealing member 330. When the key button 310 moves downward, the shaft portion 313 of the key button 310 presses the center of the bottom 333 of the sealing member 330, and the center of the bottom 333 of the sealing member 330 moves downwards as well and is stretched. The bottom 333 of the sealing member 330 has a pressing protrusion 336 that protrudes downward from the center portion of the sealing member 330 and comes into contact with the dome switch 351 of the switch device 350. The pressing protrusion 336 of the bottom 333 of the sealing member 330 is relatively thicker than the surrounding portions thereof, which is called a skirt structure 335, improving operability for the pressing of the key button 310. In the skirt structure, the thickness of the relatively thin portion may be less than 1 mm.

As described above, when the key button 310 is pushed downward, the shaft portion 313 of the key button 310 presses the center portion of the bottom 333 of the sealing member 330 and the pressing protrusion 336 of the bottom 333 of the sealing member 330 moves downwards. The pressing protrusion 336 that moves downwards presses the dome switch 351 of the switch device 350, and changes the connection state of the pressed dome switch 351.

As described above, the sealing member 330 includes a silicon rubber 1301 and a polyurethane film 1302 attached to the top surface 337 of the silicon rubber 1301. A molded body in which the polyurethane film 1302 is attached to the silicon rubber 1301 is formed by in-mold injection molding. The polyurethane film 1302 facilitates fitting the sealing member 330 into the opening of the housing 320. As a result, the polyurethane film 1302 reduces the thickness of the silicon rubber 1301 and, in particular, facilitates the formation of the above-described skirt structure, improving operability for the pressing of the key button 310. In addition, when the shaft portion 313 of the key button 310 presses the center portion of the bottom 333 of the sealing member 330, the pressing protrusion 336 disposed in the center of the bottom 333 of the sealing member 330 moves downwards. In this case, the sealing member 330 needs to have enough rigidity not to be damaged even by frequent pressing motions to the key button 310. The polyurethane film 1302 contributes to improvement of rigidity of the sealing member 330. The present disclosure is not limited to the polyurethane film 1302 and may use films of various materials that may replace the polyurethane film. In addition, the present disclosure is not limited to the silicon rubber 1301 and may use molded bodies of various materials that may replace the silicon rubber 1301. Accordingly, the sealing member 330 of the present disclosure prevents foreign matters, such as water or dust, from entering the electronic device. Since the sealing member is formed by laminating a plurality of elastic bodies made of different materials using in-mold injection molding, material properties (for example, flexibility, elasticity, rigidity, or the like) of the elastic bodies are complementary for one another, allowing the sealing member to be formed to have a small thickness. The sealing member 330 formed as described above is hardly damaged even by frequently pressing the key button 310 and improves operability for the pressing of the key button 310.

The switch device 350 includes a dome switch 351, a Flexible Printed Circuit Board (FPCB) 353, and a connector 354, and is accommodated in the inside space 327 of the housing 320. The dome switch 351 is mounted in the board 352 and comes into contact with the pressing protrusion 336 protruded downward from the sealing member 330. In addition, the board 352 is fitted into and fixed to the fixing jaw 325 of the housing 320. Furthermore, one end of the FPCB 353 is electrically connected to the board 352, and the other end is electrically connected to the connector 354.

The main board 360 is a substrate in which basic circuits and a plurality of electronic components are mounted, and is accommodated in the inside space 327 of the housing 320. The main board 360 sets an execution environment of the mobile terminal, maintains information thereof, allows the mobile terminal to be stably driven, and allows all units of the mobile terminal to swiftly perform data input/output exchange. The main board 360 has a connector that is electrically connected to the connector 354 of the switch device 350. When the dome switch 351 of the switch device 350 is pressed, the connection state of the switch device 350 is changed. The main board 360 detects the change in the connection state of the switch device 350 and processes a relevant signal.

Figure 4:
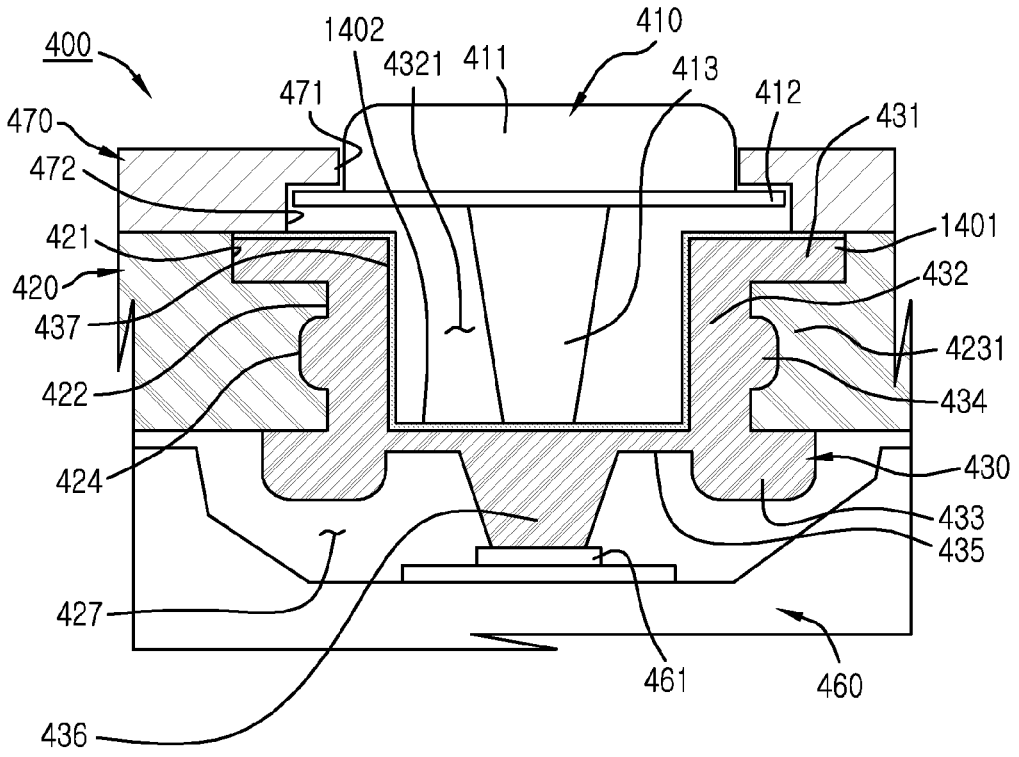
FIG. 4 is a diagram illustrating a configuration of a key button apparatus according to an embodiment of the present disclosure.

FIG. 4 is a diagram illustrating a configuration of a key button apparatus according to an embodiment of the present disclosure.

Referring to FIG. 4, the key button apparatus 400 includes a key button 410, a metal rim 470, a housing 420, a sealing member 430, and a main board 460.

The key button 410 includes a head portion 411, a flange portion 412 coupled to the bottom of the head portion 411, and a shaft portion 413 coupled to the bottom of the flange portion 412. The flange portion 412 has a larger width than the head portion 411 to prevent the key button 410 from being detached from the housing 420. The shaft portion 413 has a rod shape and, when the key button 410 is pressed, transfers relevant pressure downward. The head portion 411, the flange portion 412, and the shaft portion 413 may be molded integrally by injection molding, and be formed of metal or non-metal material. In addition, the key button 410 may be inserted into the opening formed by coupling between the metal rim 470 and the housing 420 and be moved downward. However, the key button 410 is hardly detached outside the metal rim 470.

The metal rim 470 is disposed in the rim of the electronic device and is coupled to the housing 420. The metal rim 470 may be configured similarly to the metal rim 230 of FIG. 2. The metal rim 470 has an opening. The opening of the metal rim 470 has an upper hollow 471 and a lower hollow 472 that communicates with the upper hollow 471 and is disposed under the upper hollow 471. The lower hollow 472 of the metal rim 470 has a larger width than the upper hollow 471. Since the flange portion 412 of the key button 410 is disposed in the lower hollow 472 of the metal rim 470 and has a larger width than the upper hollow 471 of the metal rim 470, the key button 410 is hardly detached outside the metal rim 470. Before the key button 410 is pressed, the upper portion of the head portion 411 of the key button 410 is maintained in a protruding state from the metal rim 470.

The housing 420 may be the front housing 210 or rear housing 220 which is described above and is coupled to the metal rim 470. The housing 420 has an opening that communicates with the opening of the metal rim 470. The opening of the housing 420 includes an upper hollow 421 and a lower hollow 422 which communicates with the upper hollow 421 and is disposed under the upper hollow 421. The upper hollow 421 of the housing 420 has a larger width than the lower hollow 422.

The sealing member 430 is fitted into the opening of the housing 420 to block communication between the outside and the inside through the opening of the housing 420. The sealing member 430 has the shape of a container having a space 4321 that accommodates the shaft portion 413 extending downward from the flange portion 412 of the key button 410. Since the sealing member 430 comes into close contact with the housing 420, there is hardly any gap between the sealing member 430 and the housing 420, so that foreign matters, such as water or dust, are prevented from entering the housing 420, that is, the inside of the electronic device through the opening of the housing 420. The sealing member 430 includes a silicon rubber 1401 and a polyurethane film 1402 attached to the top surface 437 of the silicon rubber 1401. The sealing member 430 may be molded by in-mold injection molding.

The sealing member 430 is shaped to surround a jaw 4231 that forms the lower hollow 422 of the opening of the housing 420. In addition, since the sealing member 430 is elastic, the sealing member 430 may be deformed. Therefore, there is no problem in the process of fitting the sealing member 430 into the jaw 4231 of the opening of the housing 420. The jaw 4231 of the opening of the housing 420 has three surfaces connected perpendicular to one another. The sealing member 430 has an upper wall 431, a side wall 432, and a bottom 433 which come into contact with the three surfaces of the jaw 4231 respectively. The upper wall 431 of the sealing member 430 is disposed in the upper hollow 421 of the housing 420 and may have a thickness corresponding to the height of the upper hollow 421 of the housing 420. In addition, a fitting protrusion 434 is provided in the side wall 432 of the sealing member 430, and the fitting protrusion 434 is fitted into a groove 424 formed inside the lower hollow 422 of the housing 420, contributing to firm fixing of the sealing member 430 to the opening.

The shaft portion 413 of the key button 410 passes through the space 4321 of the sealing member 430 from top to bottom and comes into contact with the bottom 433 of the sealing member 430. When the key button 410 is pushed downwards, the shaft portion 413 of the key button 410 presses the center portion of the bottom 433 of the sealing member 430 and the center portion of the bottom 433 of the sealing member 430 moves downwards and is stretched. The bottom 433 of the sealing member 430 has a pressing protrusion 436 which protrudes downward from the center portion of the sealing member 430 and comes into contact with the switch 461 of the main board 460. The pressing protrusion 436 of the bottom 433 of the sealing member 430 is relatively thicker than the surrounding portions thereof, which is called a skirt structure 435, improving operability for the pressing of the key button 410.

As described above, when the key button 410 is pushed downwards, the shaft portion 413 of the key button 410 presses the center portion of the bottom 433 of the sealing member 430 and the pressing protrusion 436 of the bottom 433 of the sealing member 430 moves downwards. The pressing protrusion 436 that moves downwards presses the switch 461 of the main board 460, and changes the connection state of the pressed switch 461.

As described above, the sealing member 430 includes a silicon rubber 1401 and a polyurethane film 1402 attached to the top surface 437 of the silicon rubber 1401. A molded body in which the polyurethane film 1402 is attached to the silicon rubber 1401 is formed by in-mold injection molding. The polyurethane film 1402 facilitates fitting the sealing member 430 into the opening of the housing 420. As a result, the polyurethane film 1402 reduces the thickness of the silicon rubber 1401 and, in particular, facilitates the formation of the above-described skirt structure, improving operability for the pressing of the key button 410. In addition, when the shaft portion 413 of the key button 410 presses the center portion of the bottom 433 of the sealing member 430, the pressing protrusion 436 disposed in the center of the bottom 433 of the sealing member 430 moves downwards. In this case, the sealing member 430 needs to have rigidity enough not to be damaged even by frequent pressing motions to the key button 410. The polyurethane film 1402 contributes to improvement of rigidity of the sealing member 430.

The main board 460 is a substrate in which basic circuits and a plurality of electronic components are mounted, and is accommodated in the inside space 427 of the housing 420. The main board 460 sets an execution environment of the mobile terminal, maintains information thereof, allows the mobile terminal to be stably driven, and allows all units of the mobile terminal to swiftly perform data input/output exchange. The main board 460 includes the switch 461 to be pressed by the pressing protrusion 436 of the sealing member 430 that moves downward, and processes signals generated by the pressing of the switch 461.

Figure 5:
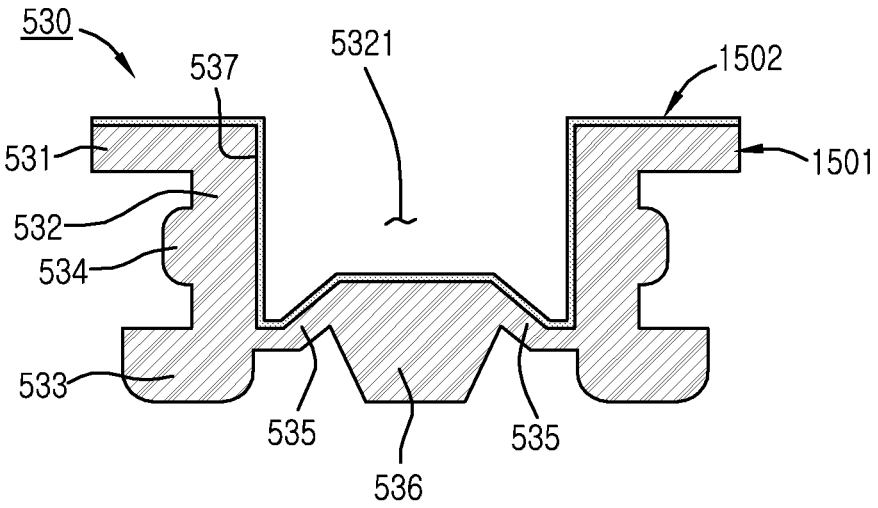
FIG. 5 is a diagram illustrating a configuration of a sealing member according to an embodiment of the present disclosure.

FIG. 5 is a diagram illustrating a configuration of a sealing member according to an embodiment of the present disclosure.

Referring to FIG. 5, the sealing member 530 is fitted into the housing 320 or 420 illustrated in FIG. 3 or 4 and is used to block communication between the outside and the inside of the housing 320 or 420 through the opening of the housing 320 or 420.

The sealing member 530 includes a silicon rubber 1501 and a polyurethane film 1502 attached to the top surface 537 of the silicon rubber 1501. The sealing member 530 may be molded by in-mold injection molding. In addition, the sealing member 530 is shaped to surround the jaw 3231 or 4231 of the opening of the housing 320 or 420. Furthermore, since the sealing member 530 is elastic, the sealing member 530 may be deformed. Therefore, there is no problem in the process of fitting the sealing member 530 into the jaw 3231 or 4231 of the opening of the housing 320 or 420. The sealing member 530 has an upper wall 531, a side wall 532 and a bottom 533 which come into contact with the housing 320 or 420. The sealing member 530 has the shape of a container having a space 5321 to accommodate elements from top to bottom. In addition, a protrusion 534 is provided in the side wall 532 of the sealing member 530 and the protrusion 534 is fitted into the groove 324 or 424 formed inside the opening of the housing 320 or 420.

The bottom 533 of the sealing member 530 has a pressing protrusion 536 protruded downward from the center portion of the sealing member 530. The pressing protrusion 536 of the bottom 533 of the sealing member 530 is relatively thicker than the surrounding portion 535 thereof and forms the above-described skirt structure. In particular, the pressing protrusion 536 of the sealing member 530 is disposed above the sealing members 330 and 430 in FIGS. 3 and 4 and a portion 535 for coupling of the pressing protrusion 536 has an inclined form.

Figure 6:
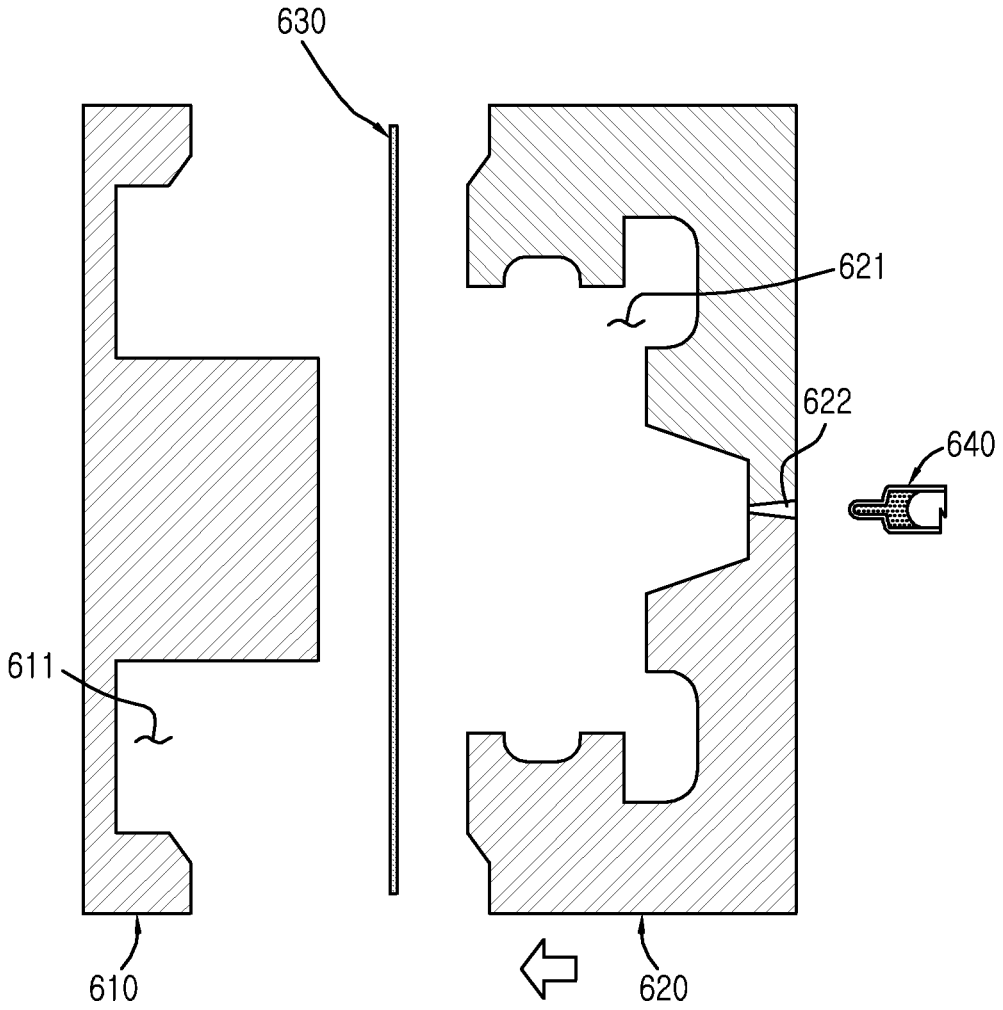
FIGS. 6 and 7 are diagrams illustrating in-mold injection molding for a sealing member according to an embodiment of the present disclosure.
Figure 7:
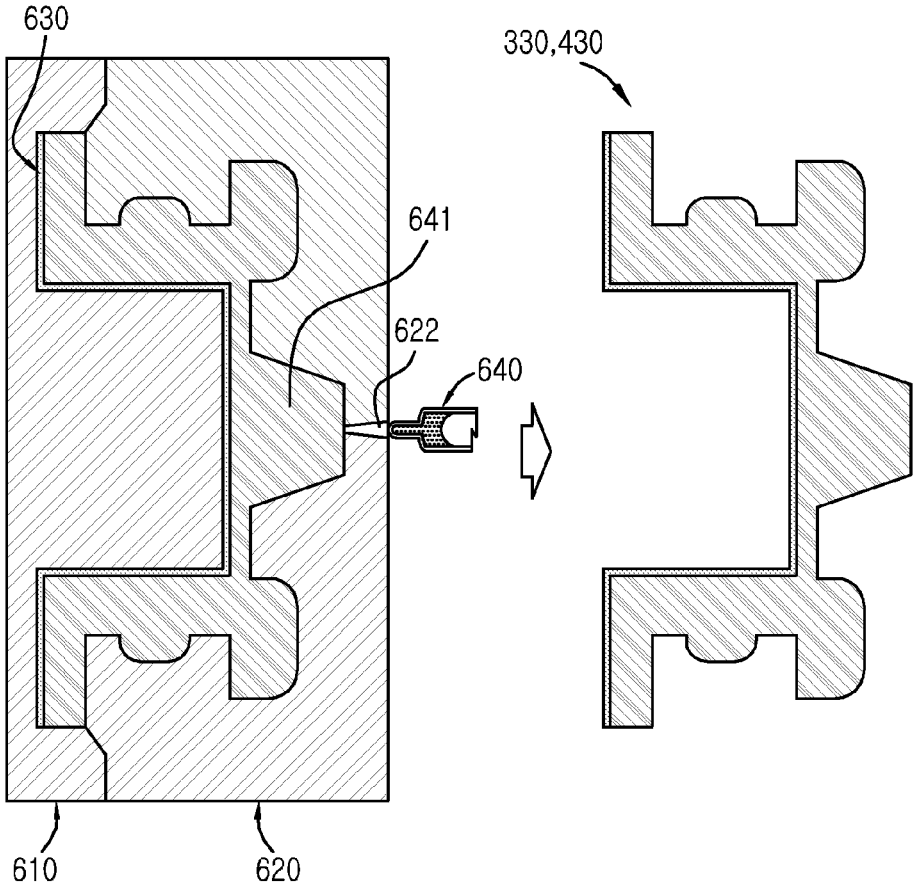

FIGS. 6 and 7 are diagrams illustrating in-mold injection molding of a sealing member according to an embodiment of the present disclosure.

Referring to FIGS. 6 and 7, an in-mold mold includes a cavity retainer plate (upper circular plate) 610 and a core retainer plate (lower circular plate) 620. The cavity retainer plate 610 has a cavity 611, that is, a space is recessed to accommodate melted resin. The core retainer plate 620 has a core 621 having a convex shape. When the core retainer plate 620 is moved and coupled to the cavity retainer plate 610, the cavity 611 and the core 621 is coupled to provide a mold space having the shape of a product.

In in-mold injection molding, a polyurethane film 630 is disposed between the cavity retainer plate 610 and the core retainer plate 620. Thereafter, the core retainer plate 620 is moved and coupled to the cavity retainer plate 610. An ejector 640 injects the silicon rubber 641 melted in the mold space through the nozzle 622 of the core retainer plate 620. By the injection of the silicon rubber 641, the polyurethane film 630 is closely adhered to the inner surface of the cavity retainer plate 610, and the injected silicon rubber 641 is adhered to the polyurethane film 630. Thereafter, cooling water is circulated to cool the polyurethane film 630 and the silicon rubber 641 that are placed in the molding space. Thereafter, the core retainer plate 620 is separated from the cavity retainer plate 610, thereby completing the sealing member 330 or 430 described above.

According to an embodiment of the present disclosure, the sealing member 330 prevents foreign matters, such as water or dust, from entering the electronic device. Since the sealing member is formed by laminating a plurality of elastic bodies made of different materials using in-mold injection molding, material properties (for example, flexibility, elasticity, rigidity, or the like) of the elastic bodies are complementary for one another, allowing the sealing member to be formed to have a small thickness. The sealing member formed as described above is hardly damaged even by frequently pressing the key button and improves operability for the pressing of the key button.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A key button apparatus comprising:
a housing having an opening;
a moveable key button;
a sealing member coupled with the housing to seal the opening of the housing, and to be deformed by movement of the key button, and comprising a plurality of elastic layers made of different materials; and
a switch disposed inside of the housing and configured to be pressed by a deformation of each of the elastic layers of the sealing member,
wherein the sealing member is formed by:
disposing a film inside a mold; and
injecting a resin inside the mold, thereby the film is coated with the resin to form the sealing member.

2. The key button apparatus of claim 1, wherein the sealing member is molded by laminating the plurality of elastic bodies made of different materials.

3. The key button apparatus of claim 1, wherein the film comprises
a polyurethane, and
the resin comprises a silicon.

4. The key button apparatus of claim 1, wherein the sealing member is fitted into the opening of the housing.

5. The key button apparatus of claim 4, wherein the sealing member comprises a protrusion fitted into a groove formed inside the opening of the housing.

6. The key button apparatus of claim 1, wherein the sealing member includes a bottom that moves by movement of the key button and presses the switch.

7. The key button apparatus of claim 6, wherein the bottom of the sealing member has a protrusion which presses the switch and which is relatively thicker than a surrounding portion of the sealing member.

8. The key button apparatus of claim 1, wherein the sealing member has a shape of a container having a space opened toward an outside of the housing.

9. The key button apparatus of claim 8, wherein an end of the key button passes though the space of the sealing member and comes into contact with a bottom of the sealing member.

10. The key button apparatus of claim 1, wherein the key button is prevented from being detached from the housing.

11. The key button apparatus of claim 1, wherein the key button comprises:
a head portion; and
a shaft portion disposed under the head portion and configured to come into contact with the sealing member and press the sealing member by movement of the key button.

12. The key button apparatus of claim 11, wherein the key button further comprises a flange portion disposed between the head portion and the shaft portion and configured to prevent the key button from being detached from the housing.

13. The key button apparatus of claim 1, wherein the opening of the housing comprises a plurality of hollow areas which communicate with one another and have different widths.

14. The key button apparatus of claim 1, wherein the opening of the housing comprises:
a first opening formed in a first housing; and
a second opening configured to communicate with the first opening and formed in a second housing coupled to the first housing.

15. The key button apparatus of claim 1, wherein the housing is a metal rim disposed in a rim of an electronic device including the key button apparatus.

16. The key button apparatus of claim 1, further comprising a main board disposed inside the housing and configured to process a signal generated when the switch is pressed.

17. The key button apparatus of claim 16, wherein the switch is fixed to the housing, spaced apart from the main board, and electrically connected to the main board through a Flexible Printed Circuit Board (FPCB).

18. The key button apparatus of claim 16, wherein the switch is mounted in the main board.

19. The key button apparatus of claim 1, wherein the switch is a dome switch.

20. The key button apparatus of claim 1, wherein the sealing member includes a protrusion contacting with the switch, the protrusion in cross section having a trapezoidal shape.

* * * * *